US006675688B2

(12) United States Patent
Ostini

(10) Patent No.: US 6,675,688 B2
(45) Date of Patent: Jan. 13, 2004

(54) MODULAR UNIT FOR CONVERTING PUNCHING MACHINES FROM SINGLE-PUNCH TO MULTIPLE-PUNCH

(75) Inventor: Giorgio Ostini, Grono (CH)

(73) Assignee: Euromac S.p.A., Formigine (IT)

( * ) Notice: Subject to any disclaimer, the term of this patent is extended or adjusted under 35 U.S.C. 154(b) by 19 days.

(21) Appl. No.: 09/819,956

(22) Filed: Mar. 28, 2001

(65) Prior Publication Data

US 2001/0025556 A1 Oct. 4, 2001

(30) Foreign Application Priority Data

Mar. 30, 2000 (GB) ..... 0007799

(51) Int. Cl.[7] ..... B26F 1/04
(52) U.S. Cl. ..... 83/552; 83/549; 83/640
(58) Field of Search ..... 83/552, 549, 557, 83/558, 550, 551, 553, 618, 620, 640, 641, 560, 559

(56) References Cited

U.S. PATENT DOCUMENTS 4,096,774 A * 6/1978 Kaufmann ..... 83/552
4,165,669 A * 8/1979 Brown et al. ..... 83/552
4,250,785 A * 2/1981 Morishita et al. ..... 83/552
4,391,174 A * 7/1983 Smeets ..... 83/552
4,486,941 A * 12/1984 Scott et al. ..... 83/552
4,532,845 A * 8/1985 Jinnouchi ..... 83/552
4,658,688 A * 4/1987 Shah et al. ..... 83/552
4,929,276 A * 5/1990 Chun et al. ..... 83/552
4,998,958 A * 3/1991 Chun et al. ..... 83/552
5,048,385 A * 9/1991 Eckert et al. ..... 83/552
5,072,620 A * 12/1991 Hill et al. ..... 83/552
5,119,666 A * 6/1992 Fujiwara ..... 83/552
5,195,413 A * 3/1993 Johnson ..... 83/552
5,211,095 A * 5/1993 Chun et al. ..... 83/552
5,299,477 A * 4/1994 Miyajima ..... 83/552
5,342,276 A * 8/1994 Fujiwara et al. ..... 83/552
5,394,335 A 2/1995 Rush
5,616,112 A * 4/1997 Seto et al. ..... 83/552
5,970,838 A * 10/1999 Perazzolo ..... 83/552
6,074,330 A * 6/2000 Ostini ..... 83/552

FOREIGN PATENT DOCUMENTS

GB 2 324 755 5/1997

* cited by examiner

*Primary Examiner*—Stephen Choi
(74) *Attorney, Agent, or Firm*—Herbert Dubno

(57) ABSTRACT

A modular conversion unit for converting punching machines from single-punch to multiple-punch comprises an upper main cylindrical magazine rotatably supported by a turret of the punching machine and provided with a plurality of radial seats for accommodating corresponding upper secondary cylindrical magazines, supporting a preset number of punches surmounted by corresponding hammer elements fitted so as to rotate, a corresponding lower main cylindrical die-holder magazine accommodated so as to rotate synchronously and in alignment with said upper cylindrical magazine in a hollow seat formed in a worktable of the punching machine and provided with a corresponding number of radial seats for lower secondary die-holders vertically aligned with the upper secondary magazines, each die-holder being provided with a plurality of dies whose number is equal to the number of the punches.

19 Claims, 7 Drawing Sheets

MODULAR UNIT FOR CONVERTING PUNCHING MACHINES FROM SINGLE-PUNCH TO MULTIPLE-PUNCH

CROSS-REFERENCE TO RELATED APPLICATIONS

This application claims priority to UK Application Serial No. 000799.0 filed Mar. 30, 2000, the disclosure of which is incorporated herein by reference.

BACKGROUND OF THE INVENTION

The present invention relates to a modular conversion unit for converting punching machines from single-punch to multiple-punch.

Conventional punching machines for machining metal plates comprise a footing provided with a worktable and an overlying turret which supports the hammer acting on the punches.

In turn, the worktable is provided with an oppositely arranged die adapted to receive the tip of the punch whenever it is actuated in order to perforate a metal plate.

These punching machines suffer a lot of drawbacks, including the fact that it is not possible to have a plurality of punches simultaneously available without having to replace them, in each instance, in the corresponding support in order to perform mutually different kinds of machining.

A second drawback of conventional punching machines is the limited space available between the surface for supporting the plates to be machined and the lower face of the punch holder, which is usually of a few centimeters.

Consequently, maintenance, generally required by jamming of the plates and punches or of the plates and the underlying dies, due to the machining waste produced by using said machines, is performed with great difficulty.

Finally, removal of the dies, which must be performed every time the punch is replaced with another one, also entails objective difficulties caused by the complexity of the maneuvers to be performed in order to extract the die from its seat: in conventional punching machines it is in fact necessary to disassemble a significant part of the working platform in order to be able to free the seat of the dies.

SUMMARY OF THE INVENTION

The aim of the present invention is to solve the above-mentioned problems of the prior art by providing a modular conversion unit for converting punching machines from single-punch to multiple-punch which allows to have available a wide range of punches ready for use without having to perform replacements and also allows, by way of its configuration, easier access for operators in the interspace between the turret and the worktable and for rapid replacement of the lower dies.

This aim and other objects, which will become more apparent hereinafter, are achieved by a modular conversion unit for converting punching machines from single-punch to multiple-punch, characterized in that it comprises an upper main cylindrical magazine which is rotatably supported by a turret of the punching machine and is provided with a plurality of radial seats for accommodating corresponding upper secondary cylindrical magazines, each of which supports a preset number of punches and is surmounted by a corresponding hammer element which is fitted so as to rotate in a controlled way, a corresponding lower main cylindrical die-holder magazine which is accommodated so as to rotate synchronously with said upper cylindrical magazine and is vertically aligned coaxially thereto in a hollow seat which is formed in a working platform of the punching machine and is provided with a corresponding number of radial seats for accommodating lower secondary die-holders supported so as to be vertically aligned with said upper secondary magazines, each die-holder being provided with a plurality of dies whose number is equal to the number of said punches, a first motor means being provided for producing a controlled rotation of said upper main cylindrical magazine with respect to said turret, a second motor means being also provided which intervenes alternatively and is meant to actuate, with a controlled rotation, said hammer elements with respect to the corresponding secondary cylindrical magazines, a third motor means being provided for the controlled rotation of said lower main cylindrical magazine with respect to said seat synchronously with said upper main magazine.

BRIEF DESCRIPTION OF THE DRAWINGS

Further characteristics and advantages of the present invention will become apparent from the following detailed description of a preferred embodiment of a modular unit for converting punching machines from single-punch to multiple-punch, illustrated only by way of non-limitative example in the accompanying drawings, wherein.

DESCRIPTION OF THE PREFERRED EMBODIMENTS

Figure 1:
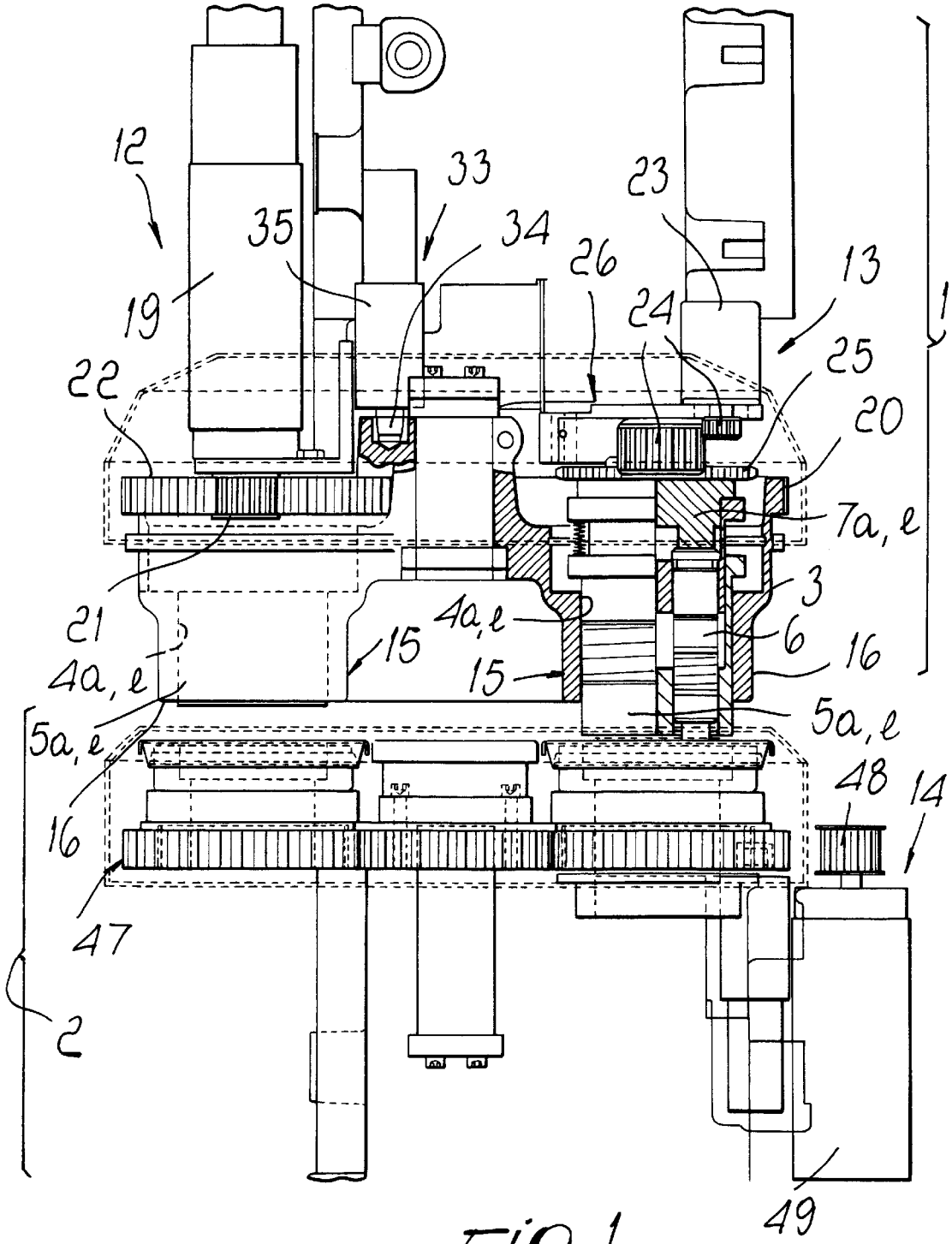
FIG. 1 is a sectional side view of the modular unit according to the invention.

With reference to the above FIGS., 1 and 2 respectively designate a punch-holder turret of a punching machine and a lower surface for supporting and machining metal plates, in which a die-holder is generally accommodated.

According to the invention, a modular conversion unit for converting the punching machine is mounted on a turret 1 and a worktable 2 and comprises an upper main cylindrical magazine 3, which is rotatably supported by the turret 1 and is provided with a series of radial seats, a total of five in the specific case, designated by 4*a*, 4*b*, 4*c*, 4*d*, 4*e*, which accommodate corresponding upper secondary cylindrical magazines 5*a*, 5*b*, 5*c*, 5*d*, 5*e*, each of which supports a preset number of punches 6 and is surmounted by corresponding hammer elements 7*a*, 7*b*, 7*c*, 7*d*, 7*e* which are mounted so as to rotate in a controlled way.

A lower main cylindrical die-holder magazine 8 is correspondingly mounted flush in the worktable 2 and rotates synchronously with the upper one 3 and is vertically aligned coaxially thereto. The main cylindrical die-holder magazine 8 is inserted in a hollow seat 8*a* formed in the worktable 2 and is provided with a corresponding number, therefore five in the specific case, of further radial seats 9*a*, 9*b*, 9*c*, 9*d*, 9*e* for accommodating a corresponding number of lower secondary die-holders 10*a*, 10*b*, 10*c*, 10*d*, 10*e* which are supported so as to be vertically aligned with the upper secondary magazines 5*a* to 5*e*.

Each die-holder 10*a* to 10*e* is provided with a plurality of dies 11 whose total number corresponds to the number of the punches 6.

The modular unit 1 is provided with a first motor means 12 for the controlled rotary actuation of the upper main cylindrical magazine 3 with respect to the turret 1; with a second motor means 13, which intervenes alternatively for the controlled rotation of the hammer elements 7*a* to 7*e* with respect to the corresponding secondary cylindrical magazines 5*a* to 5*e*; and with a third motor means 14 for the controlled rotation of the lower main cylindrical magazine 8 with respect to its seat 8*a* and synchronously with the upper main magazine 3.

The radial seats 4*a* to 4*e* for accommodating the secondary cylindrical magazines 5*a* to 5*e* are mutually separated, in the lower region, by contoured gaps 15 which are formed correspondingly in the lower region of the main cylindrical magazine 3 and form corresponding lower protrusions 16 which are directed towards the worktable 2 of the punching machine.

The lower secondary die-holders 10*a* to 10*e* are supported by the corresponding lower main die-holder 8 with interposed slider means 17 which can be extracted in a radial direction and are kept in the position for use by means of corresponding locking elements 18.

The first motor means 12 is constituted by a corresponding first motor 19, which is supported by the turret 1, and by a perimetric set of teeth 20 which is associated with the main cylindrical magazine 3; the first motor 19 supports a corresponding first sprocket 21 which is keyed on its vertically protruding transmission shaft and rotates rigidly with it: a toothed belt 22 for connection and transmission is closed in a loop around said first sprocket 21 and said perimetric set of teeth 22.

The second alternative-intervention motor means 13, adapted to produce the controlled rotation of each hammer element 7*a* to 7*e*, is constituted by a corresponding second motor 23, also provided with a second sprocket 24 which is keyed on its vertically protruding transmission shaft and is adapted to engage corresponding second sets of teeth 25 formed perimetrically with respect to each hammer element.

The second motor 23 is supported by a supporting means 26 floating on a horizontal plane and is actuated between two positions which are proximal and distal with respect to each hammer element 7*a* to 7*e* with a feeler element 27 which is kept in constant contact, through corresponding elastic means which are not shown because they are of a conventional type, with a track 28 formed perimetrically on the upper main cylindrical magazine 3; the track 28 is provided, along its circumference, with a plurality of recesses 29 arranged substantially radially at each one of the seats 4*a* to 4*e* that accommodate the upper secondary cylindrical magazines 5*a* to 5*e*.

The floating supporting means 26 is constituted by a flange 30 which is supported horizontally and so as to rotate, at one edge, about a vertical axis 31 which is rigidly coupled to the structure that supports the turret 1 of the punching machine and to which the second motor 23 is rigidly coupled.

The feeler element 27 is constituted by at least one roller 32 which is mounted, so as to rotate freely, on the flange 30 with an axis which is perpendicular thereto and so that the contact and rolling surface faces the track 28; the recesses formed therein are blended with the rolling surface of the track 28 with ramps which have a rounded profile.

Means 33 for locking the rotation in predefined angular configurations which correspond to the positions for mutual engagement of the feeler element 27 and the recesses 29 are interposed between the turret 1 and the upper main cylindrical magazine 3.

The rotary locking means 33 are constituted by at least one pivot 34 which is supported vertically by the turret 1 with an interposed actuator 35 adapted to move it vertically in a reciprocating fashion between two positions, respectively a raised return position and a lowered position for engagement with corresponding gauged holes 36 formed along a circumferential generatrix, whose outline is designated by 37, on the upper is face of the upper main cylindrical magazine 3 and is rotationally determined by the axial projection of the pivot 34 on the upper face.

The hammer elements 7*a* to 7*e* are each constituted by a cylindrical body 38 which is rotationally supported concentrically at the end of each upper secondary cylindrical magazine 5*a* to 5*e* with interposed elastic return means 39 for extracting the punch 6 and is provided, on its lower face, with a percussion tooth 40 which protrudes for alternating action on a selected punch 6.

Figure 2:
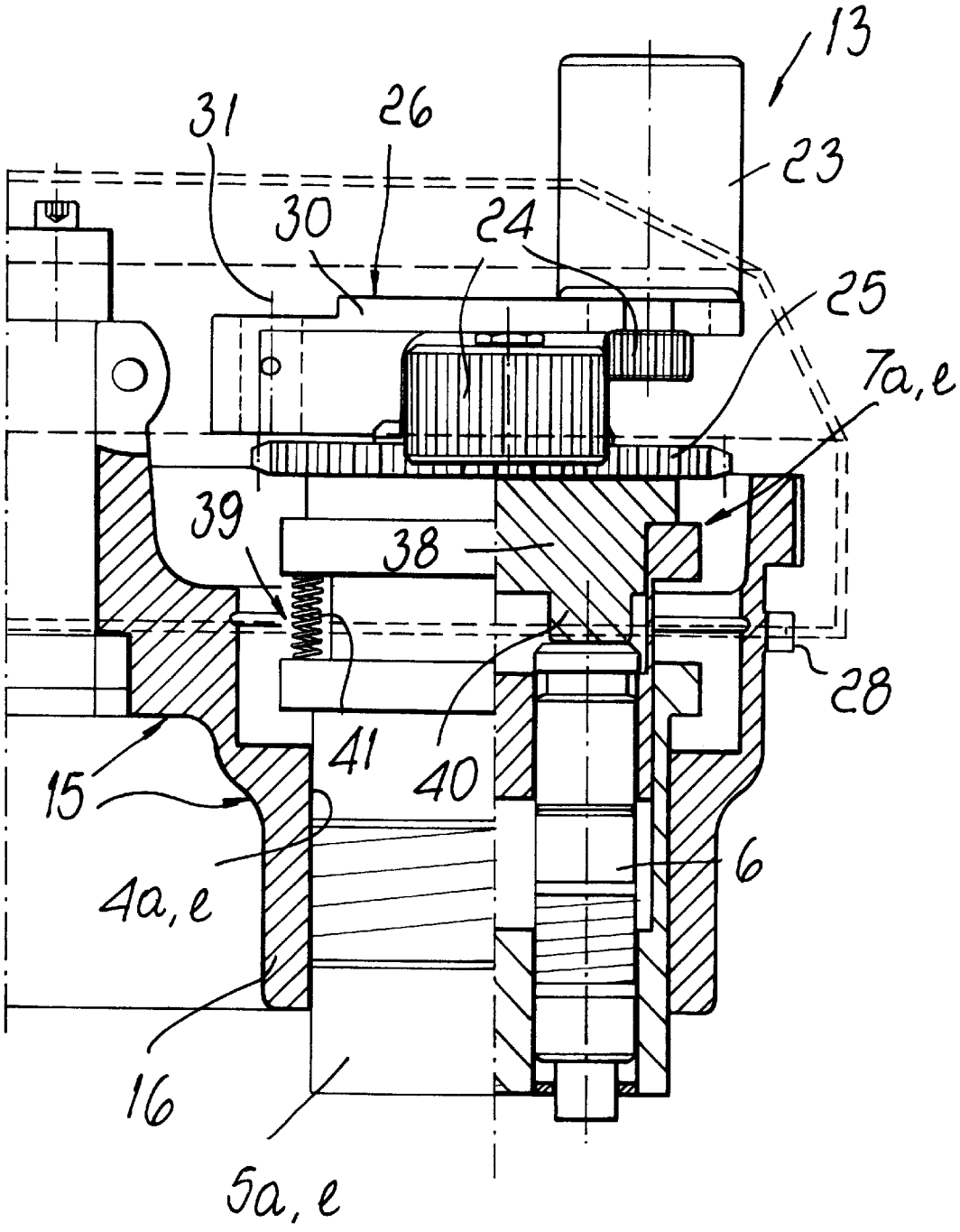
FIG. 2 is a partially sectional detailed elevation view of a secondary cylindrical container of the modular unit according to the invention.
Figure 3:
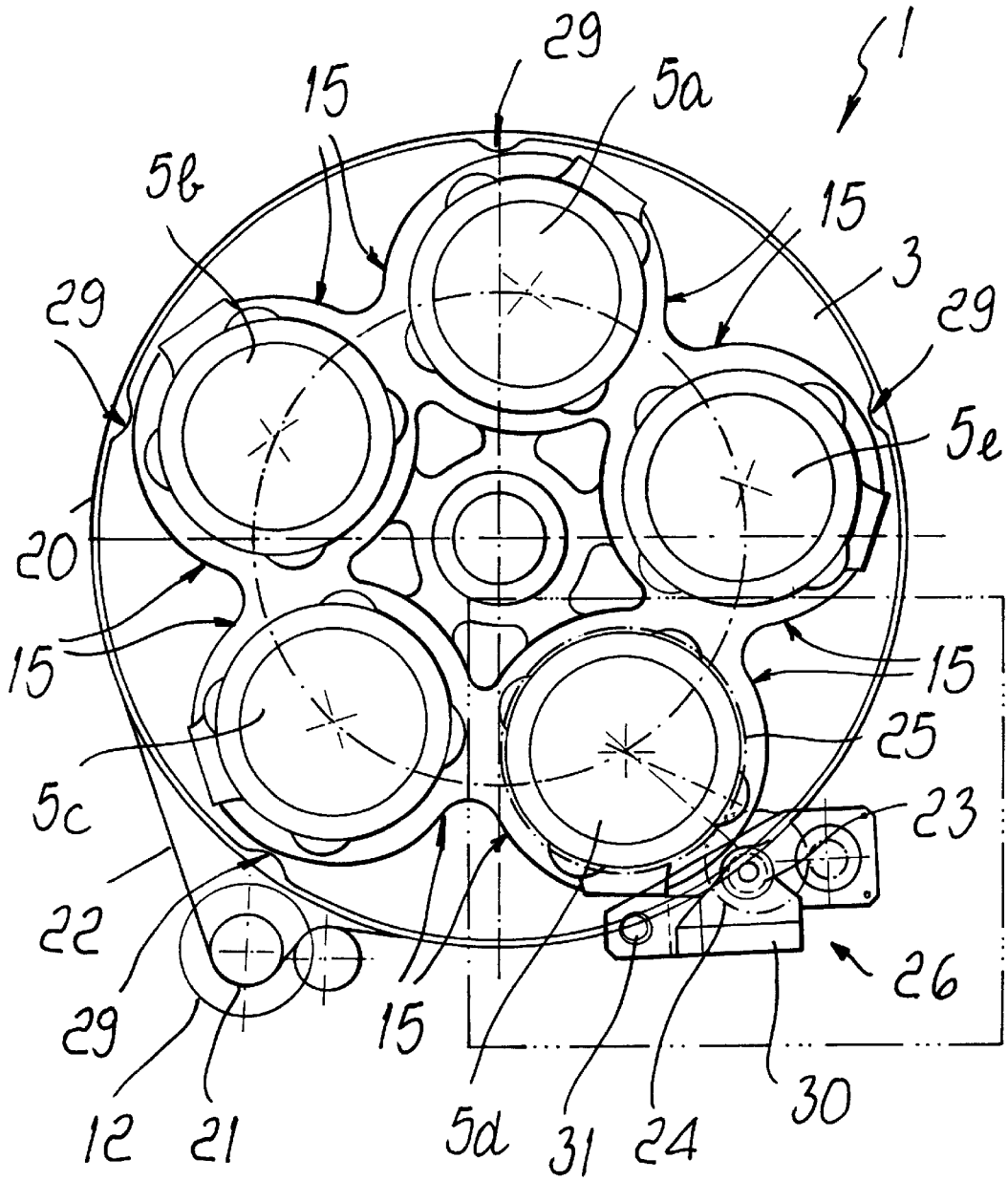
FIG. 3 is a schematic plan view of an upper main cylindrical magazine, illustrating the seats for accommodating the secondary cylindrical magazines.
Figure 4:
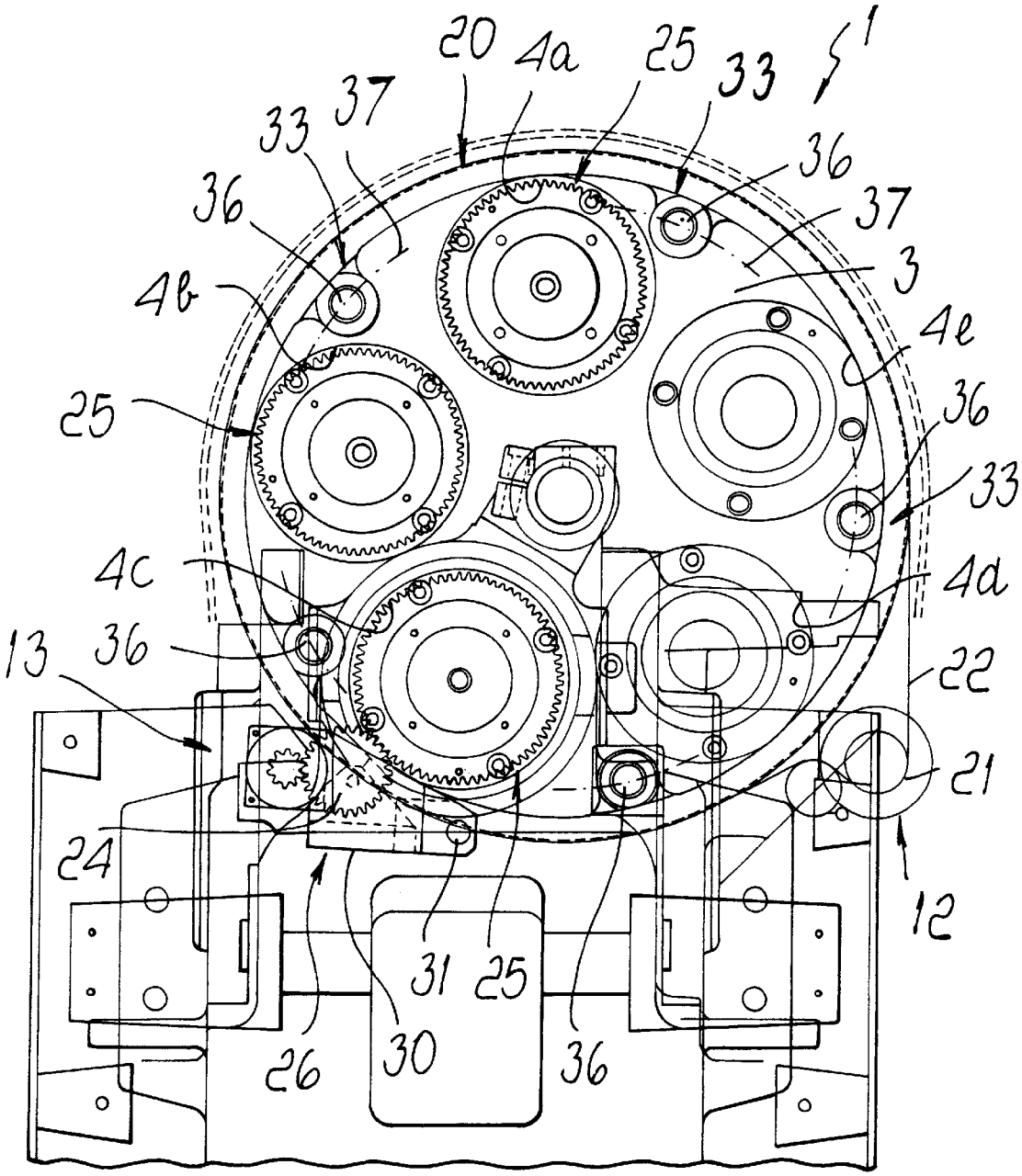
FIG. 4 is another plan view, in phantom lines, of the upper main cylindrical magazine of FIG. 3.
Figure 5:
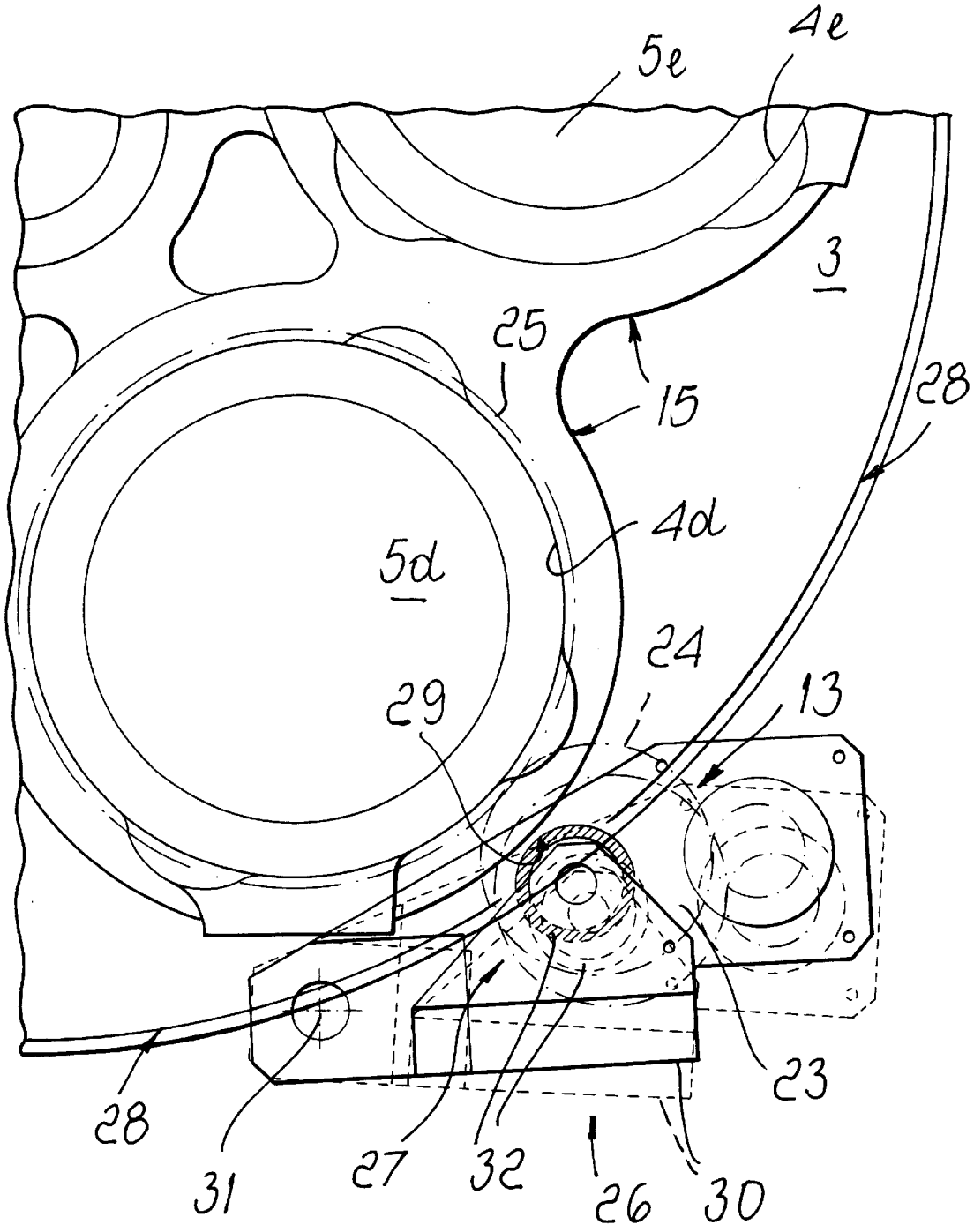
FIG. 5 is a schematic detail view of a second alternative-intervention motor means for turning the hammer elements.
Figure 6:
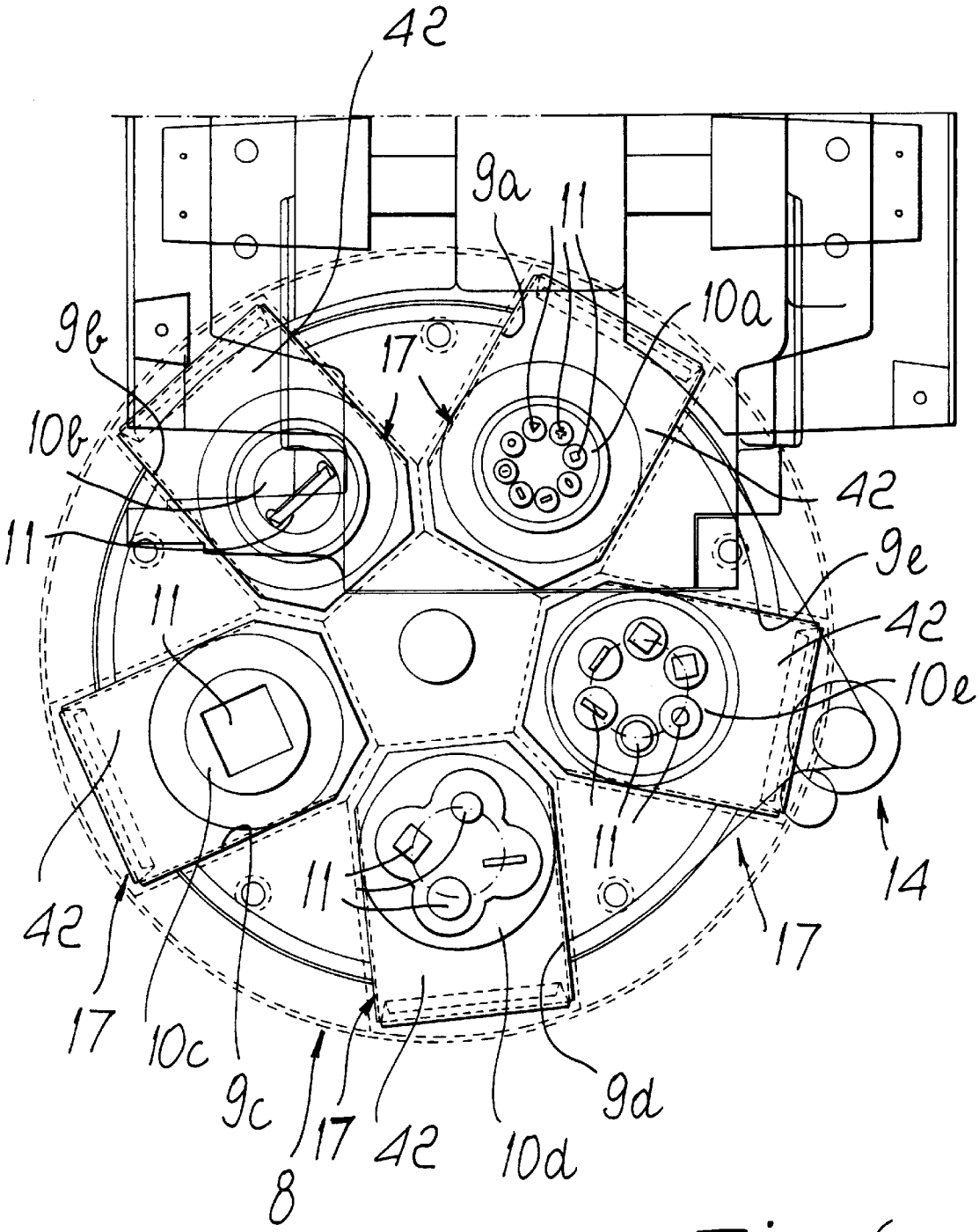
FIG. 6 is a schematic plan view of a lower main cylindrical die-holder magazine.
Figure 7:
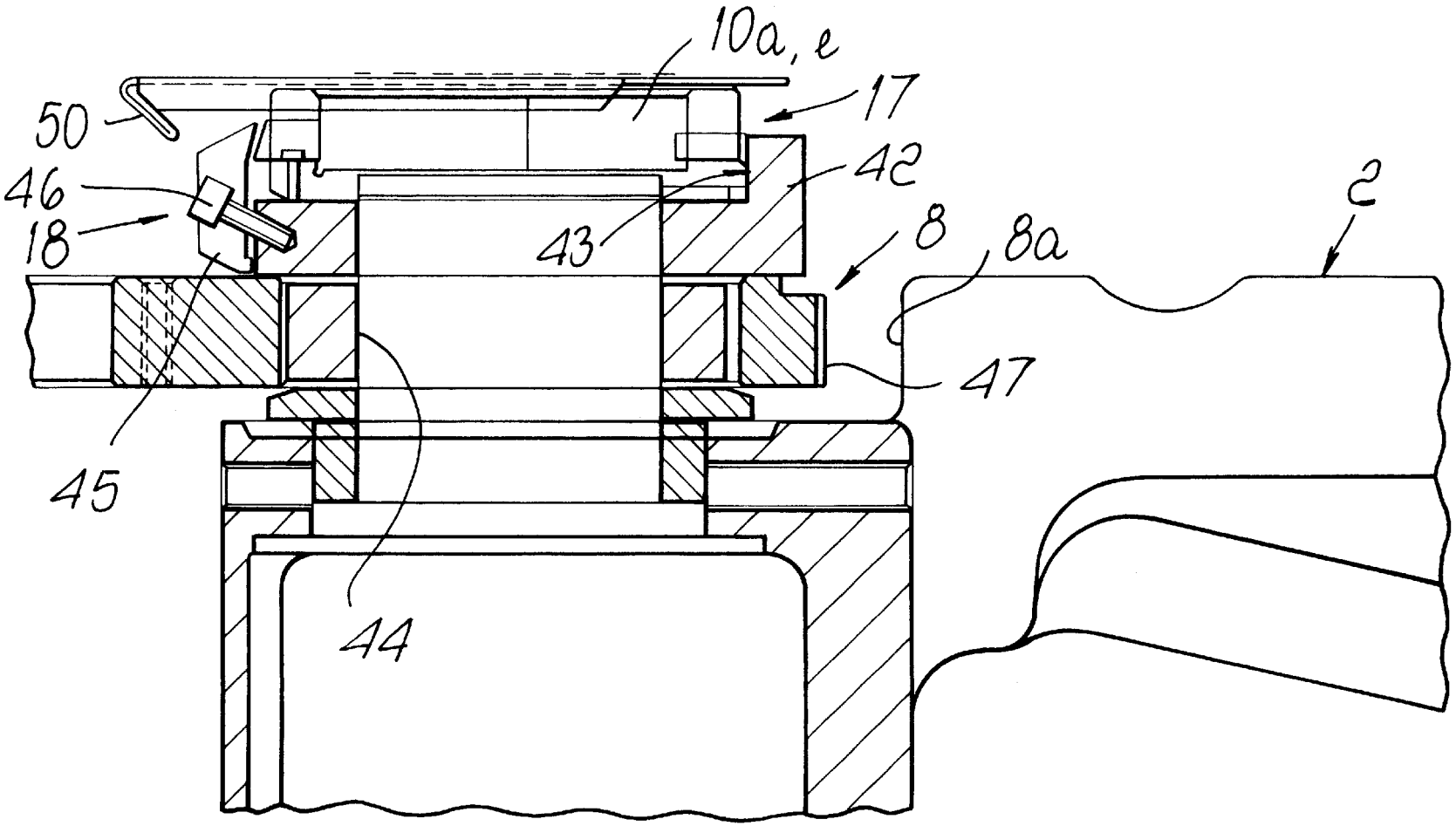
FIG. 7 is an enlarged-scale detail view of a die-holder accommodated in the corresponding seat.

The elastic return means 39 are constituted by a plurality of reactive compression springs 41 (see FIG. 2) which are interposed between the bodies 38 and the upper secondary cylindrical magazines 5*a* to 5*e*.

The slider means 17 are constituted, for each lower secondary die-holder 10*a* to 10*e*, by a flat plate 42 which is provided with a hollow cylindrical seat 43 and is insertable by sliding and so as to be guided bilaterally in a corresponding receptacle formed in the main die-holder 8.

Each hollow seat 43 is vertically aligned, in the active configuration, above an underlying opening 44 formed in the worktable 2 of the punching machine.

The locking elements 18 are constituted, for each plate 42, by a contoured prism-shaped body 45 which can be arranged in contact with the outer side of each one of the plates and can be clamped in contact with the outer side by way of screw means 46.

Finally, the third motor means 14 for controlled rotation comprises a perimetric set of teeth 47 which is formed in the lower main cylindrical magazine 8 and can be coupled to a corresponding transmission sprocket 48 which is keyed on the vertical shaft of a third motor 49 which is rigidly associated with the structure of the worktable 2 of the punching machine.

The operation of the invention is as follows: a plurality of punches 6 is accommodated in the upper secondary magazines 5*a* to 5*e* in a conventional way, and in the same way a corresponding plurality of dies 11 is prepared inside the die-holders 10*a* to 10*e*.

The secondary magazines are then placed in the respective seats 4*a* to 4*e* and the die-holders are accommodated in the plates 42, which are in turn slidingly inserted in a centripetal direction in the respective seats 9*a* to 9*e* formed in radial directions in the main cylindrical magazine 8; once insertion has been completed, the die-holders 10*a* to 10*e* are vertically aligned with the corresponding secondary cylindrical magazines 5*a* to 5*e* and, therefore, with the respective punches 6.

The plates 42 are locked in position by clamping the prism-shaped bodies 45 against their corresponding outer sides.

The operator then places a sheet of metal plate to be punched on the worktable 2, between the worktable and the overlying turret 1, and chooses the punch 6 to be used among the available punches.

This choice determines the simultaneous and synchronous rotation, activated and controlled by the electronic circuits of the punching machine, of the main cylindrical magazine 3 and of the lower one 8 in order to move onto the punching point, in an upward region, the secondary magazine that supports the selected punch and, in a downward region, the corresponding die-holder.

The synchronous rotation is activated by the first motor 19 and by the third motor 49; the motor 19 acts on the set of teeth 22 of the upper cylindrical magazine 3 with the sprocket 21 interposed, and the third motor acts in a similar way on the set of teeth 47 with the sprocket 48 interposed.

During the positioning rotation, the roller 32 of the feeler element 27 rolls on the track 28, keeping the flange 30 and, with said flange, the second motor 23 spaced from the hammer elements 7*a* to 7*e*.

When the roller 32 enters the chosen recess 29, i.e. the recess located at the secondary container that accommodates the punch 6 to be used, the flange 30 rotates about the axis 31 and moves towards said selected container.

This approach moves the second sprocket 24 so as to engage the set of teeth 25, and the activation of the second motor 23 causes the cylindrical body 38 to rotate until the percussion tooth 40 aligns itself vertically above the punch 6 to be used.

The punching machine then performs the operation, and the extraction of the punch 6 from the metal plate is facilitated by the springs 41.

In order to change the punch 6 with another one, the operator again turns the upper main cylindrical magazine 3 and the lower one 8 until the new selection is reached, and punching occurs, as described earlier, without having to perform long and troublesome replacement operations, since the range of punches 6 ready for use is quite wide.

It should also be noted that the die-holders 10*a* to 10*e* can be easily extracted, for example in order to perform maintenance or urgent interventions caused by any jamming of the punching machine due to accidental interlocking of the metal plate and the punches: the extraction of said die-holders occurs by loosening the screw means 46 and by removing the body 45: by then pulling the handle 50, said die-holder is extracted; this operation is possible even when the metal plate is in position for punching.

After extraction, the useful gap that is formed between the turret 1 and the worktable 2 increases considerably; the gap is the sum of the free space produced between the hollow seat 43 and the shaped recesses 15 formed in the upper main cylindrical magazine 3.

This space allows operators to easily access the region where the accidental interlockings occur, rapidly restoring the functionality of the punching machine, or performing the ordinary periodic maintenance operations.

In practice it has been observed that the above-described invention achieves the intended aim, i.e. it allows to have a large number of punches ready for use in a conventional punching machine without resorting to disassembly and reassembly for their replacement, and to have suitable space for interventions to be performed between the turret and the worktable.

The invention thus conceived is susceptible of numerous modifications and variations, all of which are within the scope of the appended claims.

All the details may further be replaced with other technically equivalent ones.

In practice, the materials employed, as well as the shapes and the dimensions, may be any according to requirements without thereby abandoning the scope of the protection of the appended claims.

The disclosures in UK Patent Application No. 0007799.0 from which this application claims priority are incorporated herein by reference.

What is claimed is:

1. A modular conversion unit for converting a punching machine having a turret and a worktable, from a single-punch to a multiple-punch configuration, comprising: an upper main cylindrical magazine which is rotatably supported by said turret and is provided with a plurality of radial seats; punches; hammer elements; upper secondary cylindrical magazines, accommodated in said radial seats, each of which supporting a preset number of said punches and being surmounted by a corresponding one of said hammer elements which is fitted so as to rotate in a controlled manner; a hollow seat which is formed in said worktable and is provided with a corresponding number of further radial seats; a corresponding lower main cylindrical die-holder magazine which is accommodated so as to rotate synchronously with said upper cylindrical magazine and is vertically aligned coaxially thereto in said hollow seat; lower secondary die-holders, accommodated in said further radial seats, and are supported so as to be vertically aligned with said upper secondary magazines, each die-holder being provided with a plurality of dies the number whereof is equal to the number of said punches; a first motor means for producing a controlled rotation of said upper main cylindrical magazine with respect to said turret; a second motor means with alternating operation for actuating, in controlled rotation, said hammer elements with respect to the corresponding secondary cylindrical magazines; and a third motor means for actuating in a controlled rotation said lower main cylindrical magazine with respect to said hollow seat synchronously with said upper main magazine.

2. The modular unit of claim 1, wherein said radial seats for accommodating said secondary cylindrical magazines are separated from each other in a lower region by contoured gaps which are formed correspondingly in a lower region of said main cylindrical magazine and form corresponding lower protrusions which are directed towards said worktable of the punching machine.

3. The modular unit of claim 1, comprising slider means with radial extraction and corresponding locking elements to keep in the slider means in working position interposed between, said lower secondary die-holders and the corresponding lower main die-holder supporting the secondary die-holders.

4. The modular unit of claim 1, wherein said first motor means is constituted by a corresponding first motor which is supported by said turret and by a perimetric set of teeth which is associated with said main cylindrical magazine, said first motor having a vertically protruding transmission shaft, a corresponding first sprocket which is keyed and fixedly coupled on said transmission shaft and a toothed belt for transmission and connection which is closed in a loop around said first sprocket and said perimetric set of teeth.

5. The modular unit of claim 1, wherein said second motor means for the controlled rotary actuation of each one of said hammer elements is constituted by a corresponding second motor which has a vertically protruding transmission shaft, a second sprocket keyed onto said transmission shaft for engagement with corresponding second sets of teeth formed perimetrically at each of said hammer elements.

6. The modular unit of claim 1, wherein said hammer elements are each constituted by a cylindrical body which is rotationally supported concentrically at the end of each upper secondary cylindrical magazine and comprises, interposed, elastic return means and, on a lower face thereof, a percussion tooth which protrudes for alternating action on a selected punch.

7. The modular unit of claim 6, wherein said elastic return means are constituted by a plurality of reactive compression springs which are interposed between each one of said hammer elements and a corresponding one of said upper secondary cylindrical magazines.

8. The modular unit of claim 3, wherein said slider means is constituted, for each lower secondary die-holder, by a flat plate provided with a hollow cylindrical seat, which can be slidingly inserted, so as to be guided on both sides, in a corresponding receptacle formed in said main die-holder.

9. The modular unit of claim 8, wherein each hollow cylindrical seat is vertically aligned, in an active configuration, on an underlying opening which is formed in said worktable of the punching machine.

10. The modular unit of claim 8, wherein said locking elements are constituted, for each plate, by a prism-shaped contoured body which can be arranged in contact with an outer side of each one of said plates, said body being lockable in contact with said outer side by way of screw means.

11. The modular unit of claim 1, wherein said third motor means for controlled rotation comprise: a third motor having a vertical shaft; a corresponding transmission sprocket which is keyed onto the vertical shaft of said third motor rigidly associated with said worktable of the punching machine; and a perimetric set of teeth which is formed in said lower main cylindrical magazine and is coupleable to said corresponding transmission sprocket.

12. The modular unit of claim 1, wherein said first and third motor means are actuatable so as to rotate synchronously in angular steps which are controlled and counted so as to keep said punches vertically aligned with said dies.

13. A punching machine comprising:

a turret at an upper portion of said machine;

a worktable below said turret;

an upper main cylindrical magazine rotatably supported by said turret and provided with a plurality of angularly spaced radial seats, a respective upper secondary cylindrical magazine accommodated in each of said radial seats, a plurality of punches in each of said secondary magazines, and a corresponding number of hammer elements above the punches in each of the secondary magazines, each of the secondary magazines being rotatable in the upper main cylindrical magazine;

a corresponding lower main cylindrical die-holder magazine received in said worktable, rotatable synchronously with said upper cylindrical magazine and vertically aligned coaxially therewith, said lower main cylindrical die-holder magazine having angularly spaced further radial seats adapted to register with the radial seats of said upper main cylindrical magazine;

lower secondary die-holders accommodated in said further radial seats and supported so as to be vertically aligned with said upper secondary magazines, each die-holder being provided with a plurality of dies in a number equal to a number of said punches in a corresponding upper secondary magazine;

a first motor for producing a controlled rotation of said upper main cylindrical magazine with respect to said turret;

a second motor with alternating operation for actuating, in controlled rotation, said hammer elements with respect to the corresponding secondary cylindrical magazines, said second motor having a vertically protruding transmission shaft, and a sprocket keyed onto said transmission shaft for engagement with corresponding sets of teeth formed perimetrically on each of said hammer elements;

a third motor for actuating in a controlled rotation said lower main cylindrical magazine synchronously with said upper main magazine;

a feeler element and a track formed perimetrically said upper main cylindrical magazine and being provided along its circumference with a plurality of recesses located substantially radially at each one of said radial seats for said upper secondary cylindrical magazines; and a supporting means for supporting said second motor, said supporting means floating on a horizontal plane and being actuated between two positions, a proximal position and a distal position, with respect to each of said hammer elements, by way of said feeler element which is elastically biased into constant contact with said track.

14. The punching machine of claim 13 wherein in each configuration for engagement of said feeler element in said recesses said sprocket correspondingly engages, for rotational actuation, a corresponding one of said sets of teeth of said hammer elements, and, in the opposite configuration for disengagement of said feeler element, said sprocket is disengaged from each set of teeth of the requisite hammer elements.

15. The punching machine of said claim 13 wherein said floating supporting means is constituted by a flange which is supported horizontally and is rotatable, at one edge, about a vertical axis which is rigidly coupled to a supporting structure of said turret of the punching machine and to which said second motor is rigidly coupled.

16. The punching machine of claim 14 wherein said feeler element is constituted by at least one roller which is mounted so as to rotate freely on said flange with an axis which is perpendicular thereto and so that a contact and rolling surface thereof is directed towards said track.

17. The punching machine of claim 14 wherein said recesses are blended with a rolling surface of said track with ramps which have a rounded profile.

18. The punching machine of claim 13 wherein between said turret and said upper main cylindrical magazine are interposed rotary locking means provided for arresting rotation of the main cylindrical magazine at predefined angular configurations which correspond to said configurations for engagement between said feeler and said recesses.

19. The punching machine of claim 18 wherein said rotary locking means are constituted by at least one pivot which is supported vertically by said turret and an interposed actuator for alternative vertical movement between two positions, a raised return position and a lowered engagement position.

* * * * *